US007116233B2

(12) United States Patent
Zhurin

(10) Patent No.: US 7,116,233 B2
(45) Date of Patent: Oct. 3, 2006

(54) PACKAGE PROVIDED WITH A SOUND-REPRODUCING DEVICE

(75) Inventor: Dmitry Vyacheslavovich Zhurin, Moscow (RU)

(73) Assignee: Mars LLC, Moscow (RU)

( * ) Notice: Subject to any disclaimer, the term of this patent is extended or adjusted under 35 U.S.C. 154(b) by 122 days.

(21) Appl. No.: 10/516,248

(22) PCT Filed: May 29, 2003

(86) PCT No.: PCT/RU03/00244

§ 371 (c)(1),
(2), (4) Date: Nov. 30, 2004

(87) PCT Pub. No.: WO03/104312

PCT Pub. Date: Dec. 18, 2003

(65) Prior Publication Data

US 2005/0166864 A1 Aug. 4, 2005

(30) Foreign Application Priority Data

Jun. 7, 2002 (RU) ..... 2002115075

(51) Int. Cl.
*G08B 23/00* (2006.01)
*A01K 1/10* (2006.01)

(52) U.S. Cl. ..... 340/573.1; 340/384.1; 340/568.1; 340/573.3; 446/73; 119/51.01; 119/51.5; 119/61.5; 700/231; 700/240

(58) Field of Classification Search ..... 340/384.1, 340/568.1, 573.1, 573.3; 446/73, 75, 475; 119/51.01, 51.02, 51.03, 51.11, 51.5, 61.5; 700/231, 240, 241, 289
See application file for complete search history.

(56) References Cited

U.S. PATENT DOCUMENTS 5,051,725 A * 9/1991 Caccitolo ..... 340/571
5,299,529 A * 4/1994 Ramirez ..... 119/51.11
6,145,472 A * 11/2000 Vittuari et al. ..... 119/51.5
6,318,291 B1 * 11/2001 Wolanski ..... 119/61.5
6,369,698 B1 * 4/2002 Valente ..... 340/573.1
6,803,856 B1 * 10/2004 Murphy et al. ..... 340/572.1

* cited by examiner

*Primary Examiner*—Jeffery Hofsass
*Assistant Examiner*—Samuel J Walk

(57) ABSTRACT

A sound-reproducing package comprises a housing for storing a consumer product, a disposed therein sound signal reproducing unit electronically connected to a power supply and a loudspeaker, at least one external activation sensor connected to the sound signal reproducing unit, and a package state sensor operative to form a signal corresponding to an open or closed state of the package, or the presence or absence of a consumer product in it. The package state sensor is connected to the sound signal reproducing unit operative to select from its memory sound signals for reproducing depending on the signal from the package state sensor.

13 Claims, 5 Drawing Sheets

PACKAGE PROVIDED WITH A SOUND-REPRODUCING DEVICE

FIELD OF THE INVENTION

The invention relates to product packages and more particularly to pet food packages.

BACKGROUND OF THE INVENTION

U.S. Pat. No. 6,020,823 to DeCicco, 2000, discloses a package with sound effects comprising a container for a consumer product, a sound-reproducing unit connected to a power supply and a loudspeaker, and an external activation sensor.

The package according to the above patent can reproduce sounds, when the user activates the external activation sensor. The drawback of the above package is that reproduced sound signals do not depend on the package state, in particular if the package is open or closed, full or empty.

The most close to the claimed invention is the sound-reproducing package disclosed in U.S. Pat. No. 5,795,209 to Moore, 1998. The package according to Moore comprises a housing for storing a consumer product with a sound signal reproducing unit located therein and connected to a power supply and a loudspeaker, and at least one external activation sensor connected to the first input of the sound signal reproducing unit.

The package according to Moore can comprise several external activation sensors and reproduce various sound signals, for example speech messages prerecorded in the memory of the sound signals reproducing unit upon the activation by the user of said sensors.

However, the package according to Moore has its limitations. The reproduced sound signals do not depend on the state of the package, for example if it is open or closed, empty or full. They are determined only by a sensor activated. Besides, the package according to Moore can not be used as a pet toy after the consumer product has been used, as sounds are only reproduced only upon sensors activation. The above package cannot reproduce spontaneous sounds to attract the attention of pets.

OBJECTS AND SUMMARY OF THE INVENTION

It is an object of the present invention to provide a sound-reproducing package with a wider functionality, in particular a sound-reproducing package providing the selection of sound signals reproduced in response to an external activation depending on a current state of the package.

It is also an object of the present invention to provide a device that can be used as a pet toy, a cat in particular.

These and other objects of the present invention are achieved in the package described below.

The sound-reproducing package according to the present invention comprises a housing for storing a consumer product therein, a power supply, a loud speaker, and a sound signal reproducing unit disposed in said housing and electrically connected to a power supply and a loudspeaker, at least one external activation sensor connected to the sound signal reproducing unit, and a package state sensor connected to the sound signal reproducing unit. The sound signal reproducing unit is operative to select in its memory sound signals for the reproduction depending on the signals received from the package state sensor.

Further, the package state sensor in the sound-reproducing package according to the present invention is operative to form a signal corresponding to an open or a closed state of the package.

Further, the housing has a form of a box with an openable upper side.

Further, the package state sensor comprises a fixed and a mobile contacts and a button mechanically connected to the mobile contact and located so that it can be affected by the package upper side upon its closing.

Further, the package state sensor is operative to form a signal corresponding to the presence or absence of a consumer product inside the package.

Further, the external activation sensor is operative to form a signal corresponding to the presence or absence of acceleration.

Further, the external activation sensor comprises a housing and a spring serving as its two contacts, the spring being located inside the housing so that it can touch its inner walls upon acceleration.

Further, the sound signal reproducing unit, the power supply, the loudspeaker, the external activation sensor, and the package state sensor are constructively united into a sound-reproducing module fastened to the inner surface of the package housing.

Further, The sound signal reproducing unit is operative to begin the reproduction of sound signals upon voltage changes on its input connected the package state sensor.

Further, the sound signal reproducing unit is operative to select a corresponding reproduction of sound signals depending on the polarity of voltage changes on its input connected the package state sensor.

Further, the sound signal reproducing unit is operative to reproduce at least one additional sound signal upon the termination of a pre-programmed period of time after the sound signal reproduction.

Further, the sound signal reproducing unit is operative to consequently reproduce sound signals out of a pre-programmed set of sound signals in a pre-programmed order.

Further, the sound signal reproducing unit is operative to provide the pre-programmed order of sound signals in the way of their cyclic repetition.

Further, the sound-reproducing package according to the present invention serves for storing pet food.

Further, the sound-reproducing package according to the present invention serves for storing cat food.

Further, the sound signal reproducing unit is operative to reproduce sound signals attracting attention of cats.

The present invention package makes it possible to widen its functionality by providing the selection of sound signals to be reproduced in response to an external activation depending on the current state of the package. Further, the device can be used as a pet toy, a cat toy in particular, as it provides required for this purpose sound signals and rules of their reproduction.

BRIEF DESCRIPTION OF THE DRAWINGS

Further the invention will be illustrated by the accompanying drawings.

THE PREFERRED EMBODIMENT OF THE INVENTION

Figure 1:
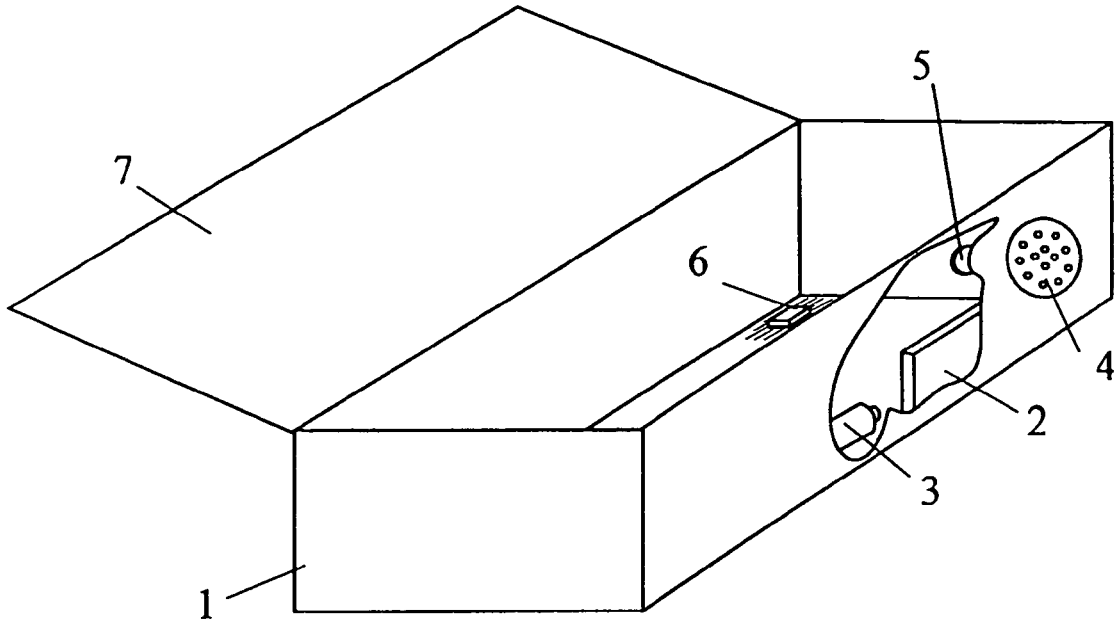
FIG. 1 shows the construction of the sound-reproducing package.
Figure 2:
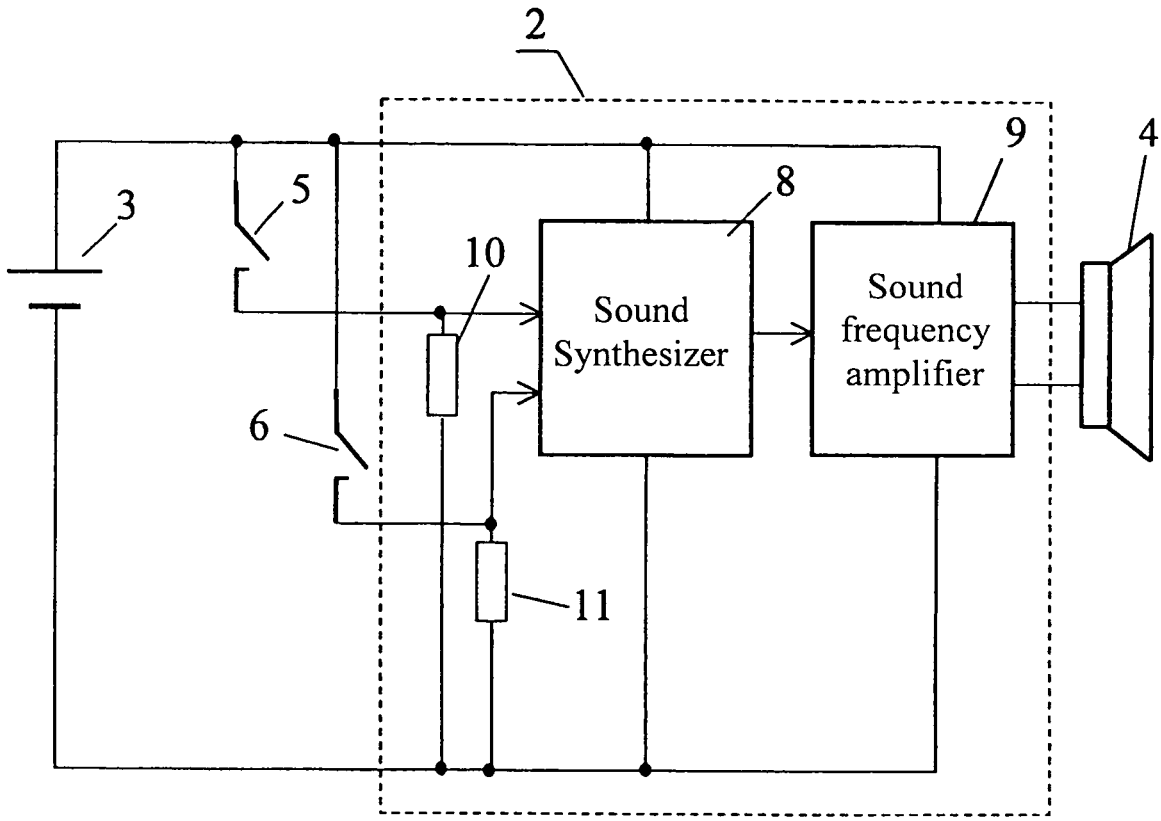
FIG. 2 shows an electrical structural circuit of the sound-reproducing package.

The sound-reproducing package (FIG. 1 and FIG. 2) comprises housing 1 for placing a consumer product, located therein sound signal reproducing unit 2 electronically connected to power supply 3 and loudspeaker 4, external activation sensor 5, and package state sensor 6, the outputs of which are connected to the first and the second inputs of sound signal reproducing unit 2, accordingly.

Sound signal reproducing unit 2 is operative to reproduce sound signals prerecorded in its memory upon receiving electric signals, for example pulses or voltage transitions on its first input. The selection of sound signals for reproducing from the memory of sound signal reproducing unit 2 depends on an electric signal, for example on the voltage level on its second input. The positive and negative voltage inputs of sound signal reproducing unit 2 are connected to the positive and negative voltage buses of power supply 3, accordingly.

Sound signal reproducing unit 2 (FIG. 2) may comprise consecutively connected sound synthesizer 8 and sound frequency amplifier 9, the positive and negative voltage supply inputs of which are connected to the corresponding supply inputs of sound signal reproducing unit 2.

Sound synthesizer 8 can be implemented as a specialized integrated circuit (IC), for example W52910, W52915 or W52920 by Winbond Electronics Corp., Taiwan. Such ICs comprise a processor, a programmable read-only memory device, wherein sound signals for reproducing and programs are recorded, electronic circuits for reproducing recorded sound signals, and other units. The total duration of recorded sound signals is 40, 60, and 80 seconds, correspondingly. The recording of sound signals and of programs for their reproduction is made at the manufacturer's facilities by the order communicated for example in a form of a diskette with sound signals in a standard digital format and the description of the order for reproducing said signals. The above ICs have four trigger inputs. When voltage transition is received on these inputs, sound signals recorded in the memory are reproduced according to the program.

The first and second inputs of sound signal reproducing unit 2 may be implemented by using two switch inputs of sound synthesizer 8 implemented as described above. When a positive or negative voltage transition is applied to any of these inputs, sound synthesizer 8 exits the waiting mode and begins to run a corresponding program. In the embodiment shown in FIG. 2, the first and second switch inputs of sound synthesizer are connected to the negative voltage bus via first and second resistors 10 and 11, correspondingly. One of the contacts of external activation sensor 5 is connected to the positive voltage bus of power supply 3, and the second contact is its output. Similarly, one of the contacts of package state sensor 6 is connected to the positive voltage bus of power supply 3, and the second contact is its output. When contacts of external activation sensor 5 and package state sensor 6 are unlocked, low voltage levels are applied to the first and second switch inputs of sound synthesizer 8.

Sound frequency amplifier 9 can be implemented as a transistor or an IC. Its output is the output of sound signal reproducing unit 2. If sound synthesizer 8 can provide a required loudness of the sound reproduction, sound frequency amplifier 9 can be absent.

Power supply 3 can be implemented as miniature batteries. A loudspeaker of a small size can be used as loudspeaker 4.

Package state sensor 6 can be operative to form a signal corresponding to an open and closed state of the package. In particular, package state sensor 6 (FIG. 3) can comprise mobile contact 12, fixed contact 13, and button 14 mechanically connected to mobile contact 12 and displaced so that package upper side 7 can affect it upon closing. When package upper side 7 is closed, button 14 is pressed, and mobile contact 12 and fixed contact 13 are unlocked.

Package state sensor 6 can also be operative to form a signal corresponding to the presence or absence of a consumer product inside the package. In this case, it may comprise a pair of contacts embedded in the bottom side of the package locking under the pressure of a consumer product (not shown in the figures).

Sound signal reproducing unit 2, power supply 3, loudspeaker 4, external activation sensor 5, and package state sensor 6 can be united into a sound-reproducing module 15 (FIG. 3) fastened to the inner surface of housing 1. Sound-reproducing module 15 has housing 16, inside of which the above-mentioned units are displaced. Inside housing 16 there is a printed circuit board (PCB) 17, on which sound signal reproducing unit 2 is mounted. On PCB 17 printed conductors provide connections between the units of the device. Sound-reproducing module 15 can be fastened to housing 1 with the help of screws, glue or other known means.

In principal, sensors 5 and 6 can be located inside housing 1, as well as outside it.

Figure 4:
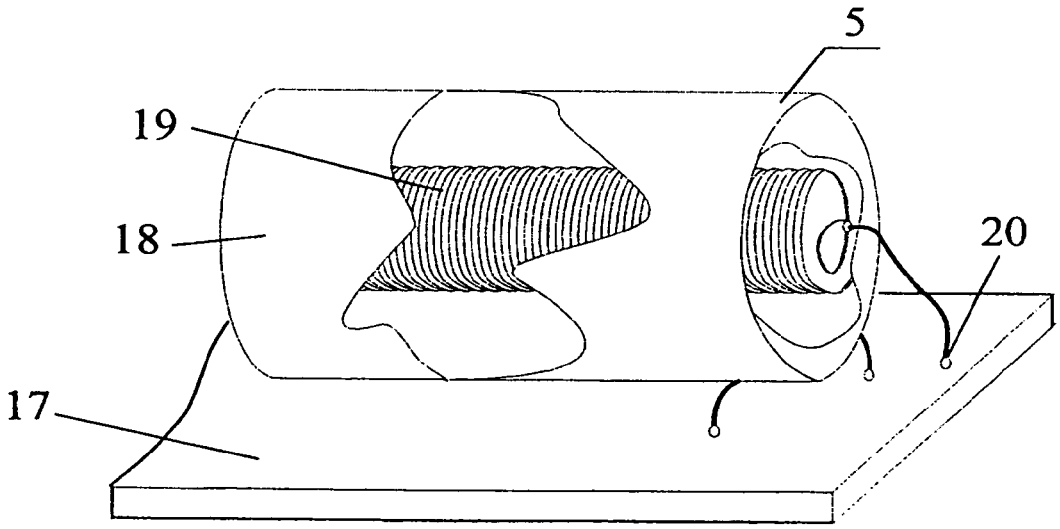
FIG. 4 shows a variant of construction of the external activation sensor.

External activation sensor 5 can be operative to form a signal corresponding to the presence or absence of the acceleration. In this case, external activation sensor (FIG. 4) can comprise housing 18 and spring 19 serving as its two contacts. Spring 19 is installed inside housing 18 so that it can touch its inside walls upon the acceleration. Housing 18 can be implemented in a form of a metal cylinder fastened on PCB 17. The first end of spring 19 is fastened to contact 20 on PCB 17, and the second end of spring 19 is loose and does not touch the inside walls of housing 18. Conductors connecting external activation sensor 5 to the other units of the device are implemented in a form of printed conductors on the surface of PCB 17 and are electrically connected to housing 18 and contact 20.

The flow-chart of the subroutine of a response to an external activation (FIG. 5) comprises program blocks 21–30, the flow-chart of subroutine of a response to the opening of the package (FIG. 6) comprises program blocks 31–37, the flow-chart of the subroutine of a response to the closing of the package (FIG. 7) comprises program blocks 38–41.

OPERATION OF THE DEVICE

Figure 3:
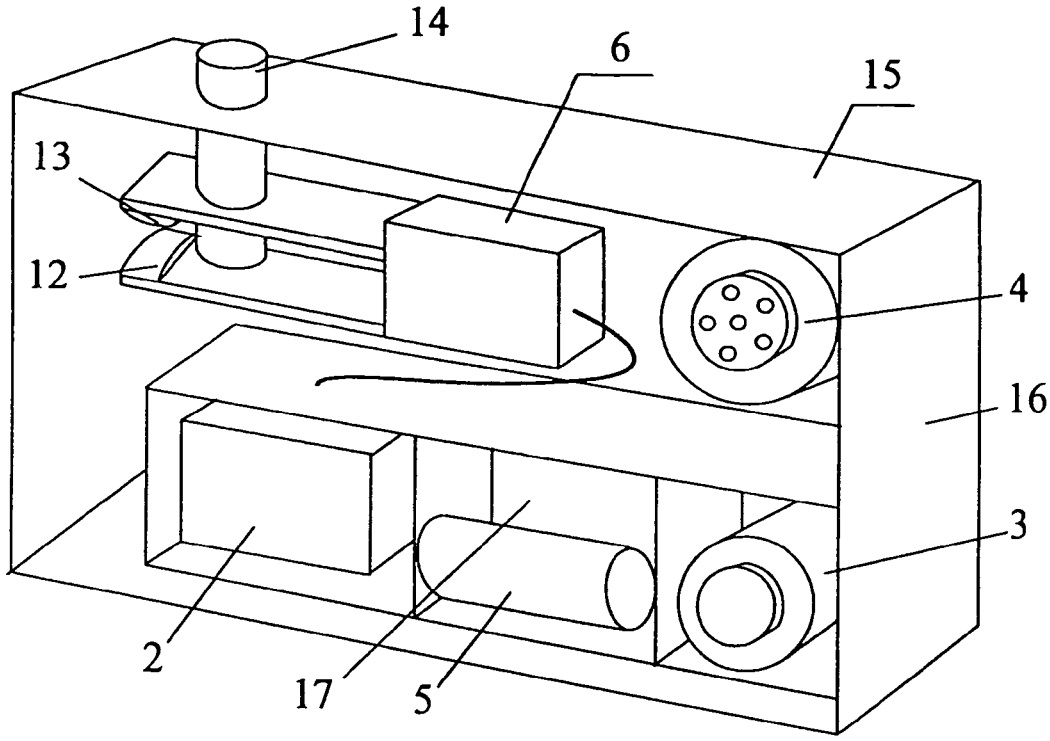
FIG. 3 shows a variant of the construction of the package state sensor and of the sound-reproducing module.

When package upper side 7 is closed, it mechanically affects button 14 connected to mobile contact 12 in package state sensor 6 (FIG. 3). Mobile and fixed contacts 12 and 13 are unlocked and the voltage level on the second input of sound signal reproducing unit 2 (FIG. 2) is low. Upon opening of package upper side 7, button 14 stops pressing on mobile contact 12 and the latter under the influence of elastic force straightens and connects with fixed contact 13. On the second input of sound signal reproducing unit 2 positive voltage transition is formed. After that a high voltage level determined by power supply 3 is set.

Upon the following closing of package upper side 7, it resumes its pressure on button 14 transferring said mechanical pressure on mobile contact 12, which deforms and unlocks with fixed contact 13. On the second input of sound signal reproducing unit 2 negative voltage transition is formed, in result the low voltage level is formed. Sound signal reproducing unit 2 can reproduce sound signals both upon positive and negative voltage transition on its second input.

When the package is immobile spring 19 in external activation sensor 5 due to its elasticity takes the position along the axis of housing 18 and does not touch its walls. Contacts in external activation sensor 5 are unlocked, and the low voltage-level is applied to the first input of sound signal reproducing unit 2.

When the package is accelerated, for example in the result of hitting, pushing, throwing and the like, the free end of spring 19 begins to oscillate touching inside walls of housing 18. Upon each touching, a short-term locking of external activation sensor 5 contacts occurs, and positive voltage pulses are formed at the first input of sound signal reproducing unit 2.

Sound signal reproducing unit 2 reproduces sounds upon receiving on its first input pulses from external activation sensor 5. At the same time, the choice of sound signals for reproducing from the sound synthesizer 8 memory is made depending on the voltage level on the second input of sound signal reproducing unit 2, i.e. depending on the package state (open or closed).

Further the description will proceed with detailed consideration of algorithms flow-charts of the claimed device operation. As a possible operation variant, the variant, when an open package reproduces sound signals making the package a pet toy and a closed package reproduces sound signals corresponding to responses to an external activation, will be considered.

Running of the program in sound synthesizer 8 begins after the power is supplied to it. When no pulses arrive from the output of external activation sensor 5 to the first input of sound signal reproducing unit 2 and when there is no change in the voltage level from the outputs of package state sensor 6 on the second input of said unit, sound synthesizer 8 goes into the waiting mode, in which the power consumed from power supply 3 is minimal (not more than 1 μA).

Figure 5:
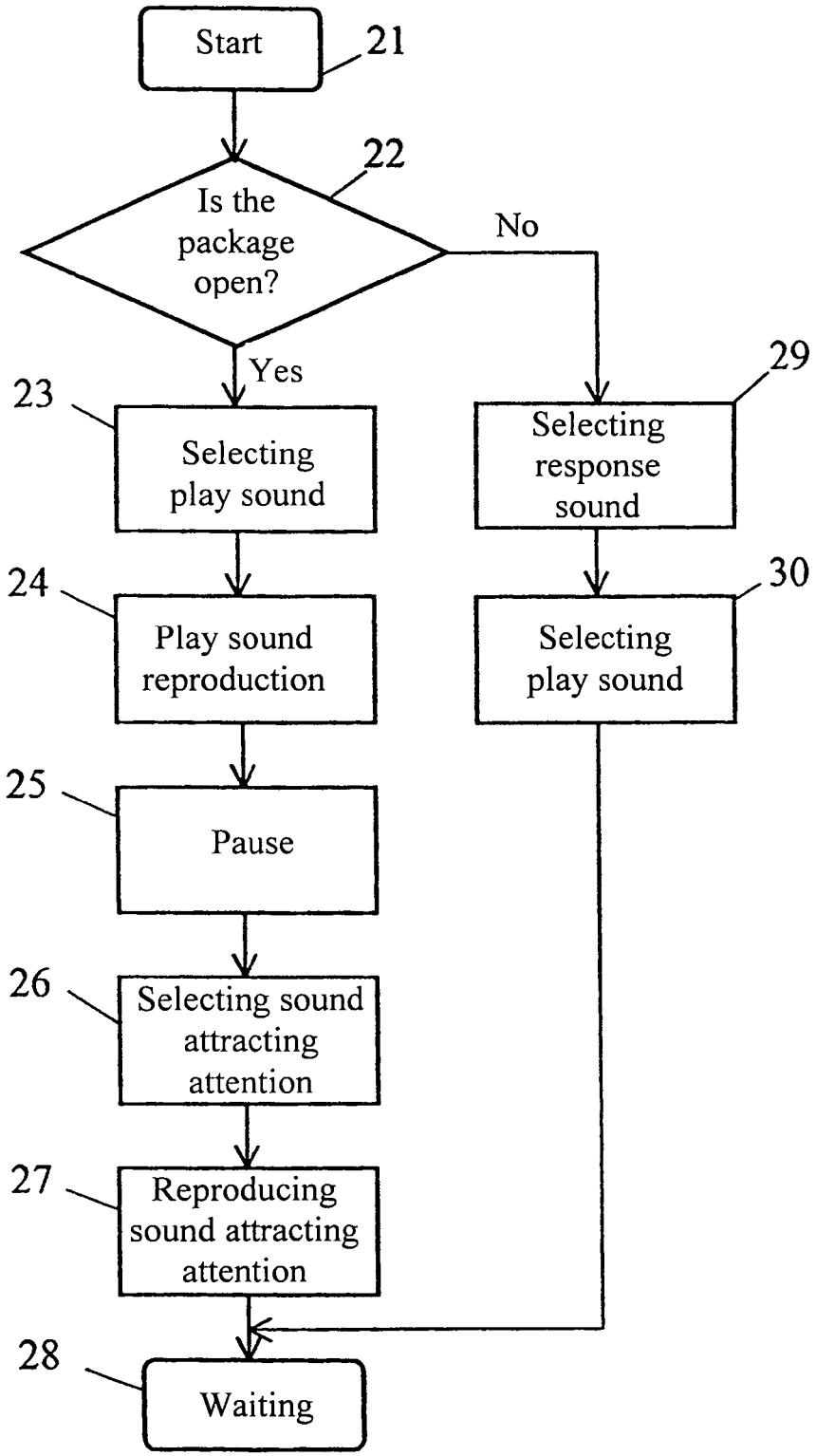
FIG. 5 shows a flowchart of the subroutine of a response to an external activation.

When a pulse arrives from the output of external activation sensor 5 at the first input of sound signal reproducing unit 2, sound synthesizer 8 exits the waiting mode and begins to run the subroutine of a response to an external activation (FIG. 5).

After the start of said subroutine (block 21) the package state is checked (block 22). To do this, the microprocessor in sound synthesizer 8 checks the voltage level on its second switch input, that is on the second input of sound signal reproducing unit 2.

If the package is open, one of the play sounds is selected (block 23). This can be the imitation of sounds made by mice, birds, etc. Then the selected sound signal is reproduced (block 24). During the selection and reproduction of the sound signal, the reset of said subroutine upon the arrival of a new pulse at the first input of sound signal reproducing unit 2 is blocked, so that the selected sound signal could be reproduced till the end.

After the sound signal is reproduced, the microprocessor in sound synthesizer 8 keeps a pause waiting for new external actions (block 25). If during this pause a pulse arrives at the first input of sound signal reproducing unit 2 from external activation sensor 5, the running of the subroutine repeats from the beginning (block 21). If no new pulses arrive from external activation sensor 5, the microprocessor in sound synthesizer 8 selects one of the sounds attracting attention (block 26), and then reproduces it (block 27). The blocking of the program reset during the reproduction of the sounds attracting the attention can be absent, so that the play sound is reproduced immediately after a pet interacts with the package.

Sounds attracting the attention can imitate sounds generated by mice or birds but are different from the play sounds to attract the attention of the pet.

If during the reproduction of sounds attracting the attention there has been no external activation of the package, the sound synthesizer IC goes into the waiting mode (block 28).

If during the checking in block 22 it is found out that the package is closed, a response sound is selected (block 29) and then reproduced (block 30). Response sounds are different from play sounds and sounds attracting the attention. For example, these can be short clicks, beeps, etc. to prevent the pet from playing with the closed package, as it is assumed that there is still some product left in the closed package. After reproducing a sound response, sound synthesizer 8 goes into the waiting mode (block 28). Upon closing and opening of the package corresponding sound signals are also reproduced.

Figure 6:
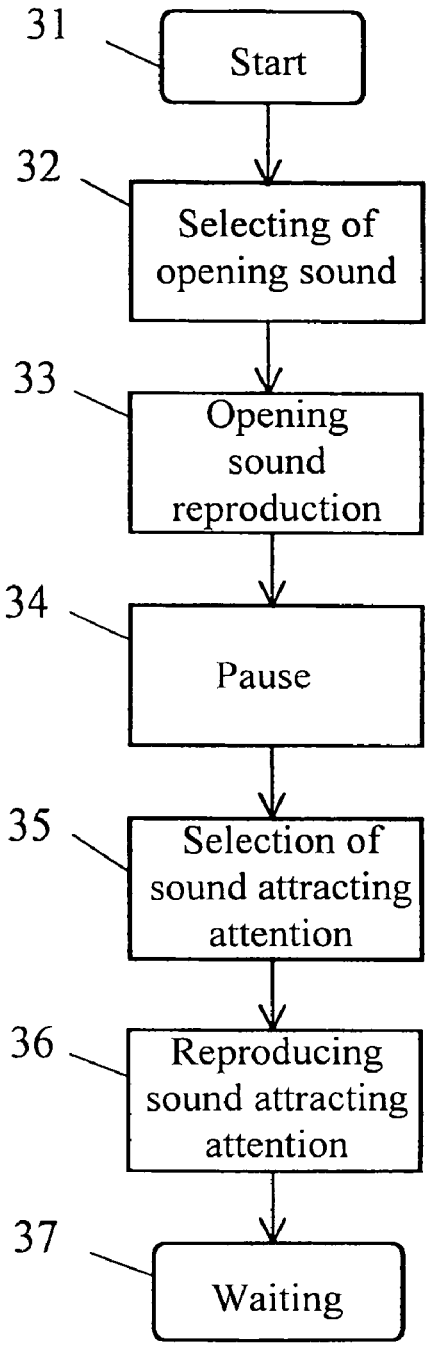
FIG. 6 shows a flowchart of the subroutine of a response to the opening of the package.

When package upper side 7 is opened, positive voltage is formed at the second input of sound signal reproducing unit 2 starting the subroutine of a response to the opening of the package. (FIG. 6). After the start of this subroutine (block 31), the opening sound signal is selected (block 32), then this signal is reproduced (block 33). Then the microprocessor in sound synthesizer 8 keeps a pause. If after the pause there has been no external activation of the package, a sound signal attracting the attention is selected (block 35) and then reproduced (block 36). If during this interval of time there has been no external activation of the package, sound synthesizer 8 goes into the waiting mode (block 37).

Figure 7:
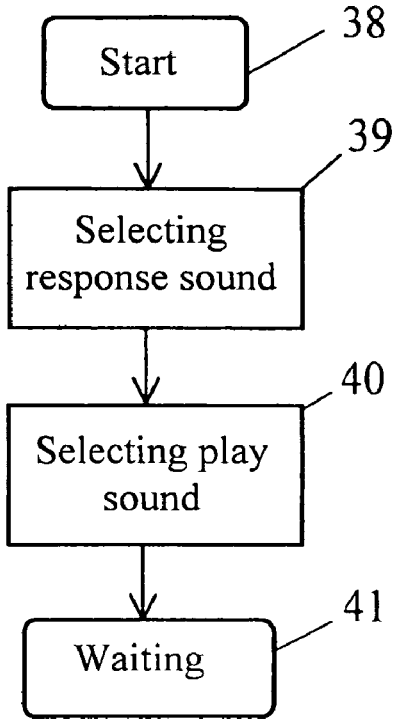
FIG. 7 shows a flowchart of the subroutine of a response to the closing of the package.

When package upper side 7 is closed, negative voltage is formed at the second input of sound signal reproducing unit 2 initiating the running of the subroutine of a response to the closing of the package (FIG. 7). After the start of said subroutine (block 38), a closing sound signal is selected (block 39), and then reproduced (block 40). After this sound synthesizer 8 goes into the waiting mode (block 41).

Opening and closing sound signals can imitate sounds made by some animals or be other sounds.

Sound signals of play, attracting attention, response, opening and closing of the package can be united into sets according to a certain feature, for example a set of sounds imitating sounds generated by mice, which can include squeak of various loudness, pitch, and length, sounds generated by a mouse when it gnaws something, etc. Sound signals from the set can be reproduced in various order, for example random or repeated as a cycle. The order of sound signals reproduction can be performed according to a script, making watching the pet play more interesting for people.

Other variants of organizing the selection of sound signals for reproductions are also possible.

The package according to the present invention can comprise several external activation sensors connected to corresponding inputs of sound signal reproducing unit 2. Besides, the device can comprise several package state sensors connected to the corresponding inputs of sound signal reproducing unit 2. For example, there can be a sensor responding to an open or closed state of the package and a sensor responding to the presence or absence of the product inside the package. The selection of sound signals for reproducing can be carried out depending on what external activation sensor has been activated and depending on signals from all package state sensors. This will provide a wide variety of device functional variants.

As it is clear from the description of the present invention, the invention provides a package that has advantages over the packages known before. The selection of sound signals reproduced in response to an external activation is made depending on the state of the package and on the change of said state. Due to this fact, sound responses of the package to the user interaction become more versatile and entertaining.

Although the description above contains many specifities, these should not be construed as limiting the scope of the invention but as merely providing illustrations of the presently preferred embodiment of this invention. Many other embodiments are possible.

INDUSTRIAL APPLICABILITY

The package according to the present invention can be used as a toy for a pet after all the pet food from the package is used. The play of the cats with the package entertains their owners and helps to keep the animal in a good shape.

Having described the preferred embodiments of the invention with the reference to the accompanying drawings, it is to be understood that the invention is not limited to this precise embodiment, and that various changes and modifications may be effective therein by one skilled in the art without departing from the scope or spirit of the invention as defined in the appended claims.

The invention claimed is:

1. A sound-reproducing package comprising:

a housing for storing a consumer product therein, a power supply, a loudspeaker, a sound signal reproducing unit disposed in said housing and electrically connected to said power supply and said loudspeaker, at least one external activation sensor connected to said sound signal reproducing unit, a package state sensor connected to said sound signal reproducing unit and operative to form a signal corresponding to a package state selected from the group consisting of an opened package and closed package, presence of a consumer product inside said package and absence of consumer product inside said package;

said sound signal reproducing unit being operative to select in its memory sound signals for the reproduction depending on the signal received from said package state sensor.

2. The sound-reproducing package of claim 1, wherein said housing has a form of a box with an openable upper side.

3. The sound-reproducing package of claim 1, wherein said external activation sensor is operative to form a signal corresponding to the presence or absence of acceleration.

4. The sound-reproducing package of claim 3, wherein said external activation sensor comprises a housing and a spring serving its two contacts, said spring being located inside said housing and able to touch the inner walls of said housing upon acceleration.

5. The sound-reproducing package of claim 1, wherein said sound signal reproducing unit, said power supply, said loudspeaker, said external activation sensor, and said package state sensor are constructively united into a sound-reproducing module fastened to the inner surface of said package housing.

6. The sound-reproducing package of claim 1, wherein said sound signal reproducing unit is operative to begin the reproduction of sound signals upon voltage changes on its input connected to said package state sensor.

7. The sound-reproducing package of claim 6, wherein said sound signal reproducing unit is operative to select the corresponding reproduction of sound signals depending on the polarity of voltage change on its input connected to said package state sensor.

8. The sound-reproducing package of claim 1, wherein said sound signal reproducing unit is operative to reproduce at least one additional sound signal at the end of a pre-programmed period of time after the termination of the sound signal reproduction.

9. The sound-reproducing package of claim 1, wherein said sound signal reproducing unit is operative to consequently reproduce sound signals out of a pre-programmed set of sound signals in a pre-programmed order.

10. The sound-reproducing package of claim 9, wherein said sound signal reproducing unit is operative to provide said pre-programmed order of sound signals reproduction in the way of their cyclic repetition.

11. The sound-reproducing package of claim 1, wherein said package serves for storing pet food.

12. The sound-reproducing package of claim 11, wherein said packages serves for storing cat food.

13. The sound-reproducing package of claim 12, wherein said sound signal reproducing unit is operative to reproduce sound signals attracting attention of cats.

* * * * *